US007380404B2

(12) United States Patent
Kang et al.

(10) Patent No.: US 7,380,404 B2
(45) Date of Patent: Jun. 3, 2008

(54) METHOD AND CONTROL FOR DETERMINING LOW REFRIGERANT CHARGE

(75) Inventors: Pengju Kang, Hartford, CT (US); Mohsen Farzad, Glastonbury, CT (US); Alan M. Finn, Hebron, CT (US); Payman Sadegh, Manchester, CT (US)

(73) Assignee: Carrier Corporation, Syracuse, NY (US)

( * ) Notice: Subject to any disclaimer, the term of this patent is extended or adjusted under 35 U.S.C. 154(b) by 513 days.

(21) Appl. No.: 11/029,712

(22) Filed: Jan. 5, 2005

(65) Prior Publication Data

US 2006/0144059 A1 Jul. 6, 2006

(51) Int. Cl.
*F25B 49/00* (2006.01)
*F25B 45/00* (2006.01)
*G01K 13/00* (2006.01)

(52) U.S. Cl. ..... 62/127; 62/129; 62/149; 62/208

(58) Field of Classification Search ..... 62/127, 62/129, 149, 208, 228.3
See application file for complete search history.

(56) References Cited

U.S. PATENT DOCUMENTS 4,653,288 A * 3/1987 Sayo et al. ..... 62/210
5,586,445 A * 12/1996 Bessler ..... 62/126

* cited by examiner

*Primary Examiner*—Marc Norman
(74) *Attorney, Agent, or Firm*—Carlson, Gaskey & Olds

(57) ABSTRACT

A refrigerant system is provided with a method and a control programmed to perform the method, in which a low charge of refrigerant is identified. The mass flow of refrigerant through the system is calculated utilizing at least two different methods. The two calculated mass flow rates are compared, and if they differ by more than predetermined amount, a determination is made that there is a low charge of refrigerant within the system.

17 Claims, 1 Drawing Sheet

METHOD AND CONTROL FOR DETERMINING LOW REFRIGERANT CHARGE

BACKGROUND OF THE INVENTION

This invention relates to a simple method and control for identifying a low charge of refrigerant in a refrigerant system.

Refrigerant systems are utilized to condition an environment and may include air conditioners or heat pumps. In a traditional refrigerant system, refrigerant is routed between several components through sealed connections. Over time, and for various reasons, some of the refrigerant may escape the sealed system. This can result in there being a lower charge of refrigerant than would be desirable.

When there is a low charge of refrigerant, it becomes more difficult for the system to provide its function such as cooling air being directed into an environment. Additional load is put on the compressor, and the compressor may fail, or the system may not adequately condition the air being directed into the environment.

Thus, various methods have been utilized to identify a low charge of refrigerant. One simple method looks at whether the refrigerant from an evaporator being directed to a compressor, has excessively high super heat. A high super heat value is indicative of a low charge of refrigerant.

However, with modern refrigerant systems, the expansion valves directing the refrigerant to the evaporator are controlled electronically in response to the amount of super heat upon sensing high super heat, the control adjusts the expansion valve to result in the amount of super heat being moved downwardly. Such control can mask the low charge.

Thus, a simplified method of identifying a low charge of refrigerant that would be useful in complex refrigerant systems is desired.

SUMMARY OF THE INVENTION

In a disclosed embodiment of this invention, a method and a control programmed to perform the method take in various standard variables from a refrigerant system. As is known, and for various diagnostic purposes, pressure and temperature readings are taken at various points within a refrigerant system. These standard readings are utilized with this invention to determine the mass flow rate of refrigerant. The mass flow rate of refrigerant can be calculated in any one of several manners, and utilizing different ones of the standard variables. By comparing two of these mass flow calculations, the method determines whether the calculations are within a margin of error of each other. In a low charge situation, the mass flow rate calculations would be inaccurate, and thus different from each other. When a sufficient difference in calculated mass flow rates is identified, the control identifies the system as having a low charge.

These and other features of the present invention can be best understood from the following specification and drawings, the following of which is a brief description.

DETAILED DESCRIPTION OF THE PREFERRED EMBODIMENT

Figure 1:
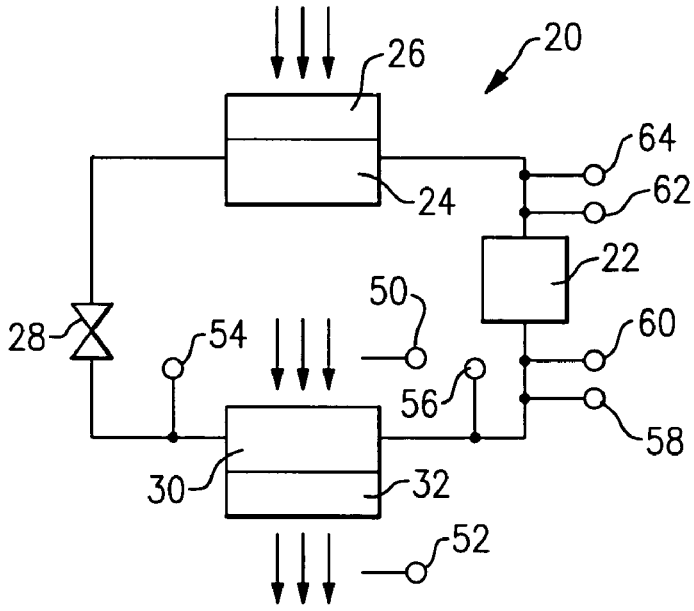
FIG. 1 is a schematic view of a refrigerant system for performing the present invention.
Figure 2:
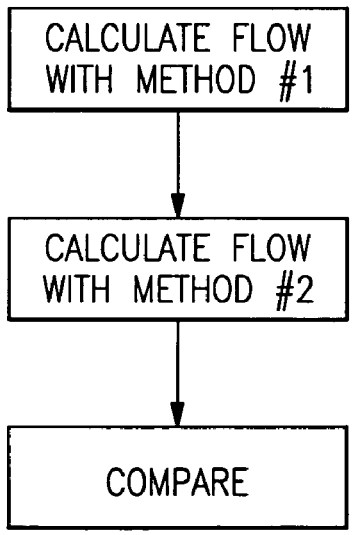
FIG. 2 is a flow chart of the present invention.

FIG. 1 shows a refrigerant system 20 incorporating a compressor 22 for compressing refrigerant and delivering it to a condenser 24. A fan 26 drives air over the condenser, and in an air conditioning mode, removes heat from the refrigerant in the condenser. Downstream of the condenser 24 is an expansion device 28. In complex systems, this expansion device may be electronically controlled with a closed feedback loop based upon a super heat temperature of the refrigerant approaching the compressor 22.

Downstream of the expansion device 28 is an evaporator 30 having a fan 32 for pulling air over the evaporator 30 and into an environment to be conditioned. Temperature readings may be taken on the air approaching the evaporator by sensor 50, the air having passed over the evaporator by sensor 52, the refrigerant approaching the evaporator by sensor 54, the refrigerant downstream of the evaporator by sensor 56, the pressure of the refrigerant approaching the compressor by sensor 58, the temperature of the refrigerant approaching the compressor 22 by sensor 60, and the pressure (sensor 62) and temperature (sensor 64) of the refrigerant downstream of the compressor. Such readings are already taken by many modern refrigerant systems and utilized for various diagnostic purposes.

A refrigerant mass flow rate for refrigerant passing through the expansion valve 28 may be calculated by a known equation such as:

$$m_{r1}=\%\ C_v\sqrt{\Delta p} \tag{1}$$

The refrigerant mass flow rate is a function of a differential pressure the valve ($\Delta p$) and the percentage of valve opening (%). $C_v$ is a characteristic constant of the valve. Using this predetermined valve characteristic, the refrigerant flow rate can be metered if the differential pressure is measurable.

It is possible that a constant differential pressure valve be used for refrigerant flow regulation, and in such a case, there is no need for the measurement of differential pressure across the valve. Other types of regulating valve require the direct measurement or indirect estimation of the differential pressure across the valve for flow rate calculation.

Shown in FIG. 1 are four sensors (50, 52, 54, 56) monitoring the evaporator operation. The heat transfer equations for counter flow heat exchangers are:

Air side:

$$Q=\frac{m_a c_{p1}(T_{1in}-T_{1out})}{SHR} \tag{2}$$

Refrigerant side:

$$Q=m_{r1}(h_{r1}-h_{r2}) \tag{3}$$

where

Q=rate of heat transfer, W $m_a$=mass flow rate of air kg/s $m_{r1}$=mass flow rate of refrigerant kg/s $c_{p1}$=specific heats of dry air, J/kgK $T_1$in/out=air temperature (sensors 50, 52), ° C.

SHR=sensible heat ratio determined from the inlet and outlet air conditions $h_{r1}$, $h_{r2}$=specific enthalpies of refrigerant vapor at inlet and outlet of evaporator, J/Kg Refrigerant enthalpies $h_{r1}$, $h_{r2}$ can be obtained from the refrigerant properties using the temperature and pressure measurement. Under the condition that SHR and air mass flow rate are known, the refrigerant flow rate can be solved from equations (2) and (3):

$$m_r = \frac{m_a c_{p1}(T_{1in} - T_{1out})}{SHR(h_{r1} - h_{r2})} \tag{4}$$

The refrigerant mass flow rate can also be estimated using the compressor model, obtained from the manufacturer data. A three-term model to approximate the theoretical model of volumetric flow rate of a compressor is given as:

$$V_{suc}=(a-bP_r^c) \tag{5}$$

where a, b, c are constants estimated from the manufacturer calorimeter data $$P_r = \frac{P_{dis}}{P_{suc}}$$

is the compressor pressure ratio, which is the ratio between discharge pressure ($P_{dis}$, sensor 62) and suction pressure ($P_{suc}$, sensor 58).

The volumetric flow rate is obtained using the density of refrigerant according to:

$$m_{r2}=V_{suc}\rho \tag{6}$$

where ρ is the density of refrigerant

For those who are skilled in this art, the refrigerant flow rate may also be calculated using a compressor model of a different format from (5).

The refrigerant flow rate estimated according to the compressor model in (6) should be close to the value calculated using either (1) or (4) under normal conditions. Under low charge conditions, large discrepancies between these two flow rate values will occur.

Consequently, an alarm indicator is defined as the difference, or residue (Θ) between two flow rate values:

$$\Theta=|m_{r1}-m_{r2}| \tag{7}$$

When the residue value exceeds a predetermined threshold, a decision is made that the charge is low. Tracking the estimated residue values over time also helps in predicting a gradual leaking of charge.

This technique can be extended to more complex systems that have multiple evaporators known as the multi-air conditioning systems. The extended low charge indicator is written as the compressor flow rate and the total of flow rates passing individual evaporators:

$$\Theta = \left| m_{r1} - \sum_i m_{r2}^i \right| \tag{8}$$

where i is the index number of evaporators in the system, and $m_{r2}^i$ is the refrigerant air flow rate through the $i^{th}$ heat evaporator.

Thus, the present invention utilizes existing sensors to provide an indication of a low charge.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A refrigerant system comprising:

a compressor for compressing refrigerant and delivering refrigerant downstream to a condenser, refrigerant passing from said condenser to an expansion device, and from said expansion device to an evaporator, refrigerant from said evaporator passing back to said compressor;

a control for controlling said refrigerant system, said control being provided with system variables from a plurality of sensors, and said control being operable to calculate mass flow rates by at least two methods based upon system variables, and said control being operable to compare the mass flow rate calculations by said two methods to each other, and indicate a low charge of refrigerant in said refrigerant system should said two mass flow rate calculations differ by more than a predetermined amount; and at least one of said two methods is calculated based upon a compressor model, and looking at a pressure ratio across said compressor.

2. The refrigerant system as set forth in claim 1, wherein the other of said two methods is calculated by taking the differential pressure across said expansion device and utilizing a formula to calculate mass flow rate.

3. The refrigerant system as set forth in claim 1, wherein the other of said two methods is calculated by looking at a formula based upon a heat transfer rate at an evaporator.

4. The refrigerant system as set forth in claim 1, wherein said at least one method utilizes the formula:

$$m_r=V_{suc}\rho,$$

wherein $$V_{suc}=(a-bP_r^c),$$

and a, b, and c are constants estimated from a manufacturer's calorimeter data, and $$P_r = \frac{P_{dis}}{P_{suc}},$$

which is the ratio between a discharge pressure and a suction pressure across the compressor.

5. The refrigerant system as set forth in claim 1, wherein at least one of said two methods utilizes a pressure ratio across the expansion device, and the following formula:

$$m_r=\%C_v\sqrt{\Delta p},$$

wherein said Δp value is a differential pressure across said expansion device, and the % symbol is the percentage of expansion device opening, with $C_v$ being a characteristic constant of the expansion device.

6. The refrigerant system as set forth in claim 1, wherein at least one of said two methods utilizes the following formula:

$$m_r = \frac{m_a c_{p1}(T_{1in} - T_{1out})}{SHR(h_{r1} - h_{r2})},$$

wherein $m_a$=mass flow rate of air kg/s $m_r$=mass flow rate of refrigerant kg/s $c_{p1}$=specific heats of dry air, J/kgK $T_1$in/out=air temperature (into and out of said evaporator), ° C.

SHR=sensible heat ratio determined from the air conditions into and out of said evaporator $h_{r1}$, $h_{r2}$=specific enthalpies of refrigerant vapor into and out of said evaporator, J/Kg.

7. A control for a refrigerant system comprising:

a control for controlling a refrigerant system, said control being provided with system variables from a plurality of sensors, and said control being operable to calculate mass flow rates by at least two methods based upon system variables, and said control being operable to compare the mass flow rate calculations by said two methods to each other, and indicate a low charge of refrigerant in said refrigerant system should said two mass flow rate calculations differ by more than a predetermined amount; and at least one of said two methods is calculated based upon a compressor model, and looking at a pressure ratio across a compressor.

8. The control as set forth in claim 7, wherein the other of said two methods is calculated by taking the differential pressure across said expansion device and utilizing a formula to calculate mass flow rate.

9. The control as set forth in claim 7, wherein the other of said two methods is calculated by looking at a formula based upon a heat transfer rate across an evaporator.

10. The control as set forth in claim 7, wherein at least one method utilizes the formula:

$$m_r = V_{suc}\rho,$$

wherein $$V_{suc} = (a - bP_r^c),$$

and a, b, and c are constants estimated from a manufacturer's calorimeter data, and $$P_r = \frac{P_{dis}}{P_{suc}},$$

which is the ratio between a discharge pressure and a suction pressure across an associated compressor.

11. The control as set forth in claim 7, wherein at least one of said two methods utilizes a pressure ratio across an associated expansion device, and the following formula:

$$m_r = \%C_v\sqrt{\Delta p},$$

wherein said Δp value is a differential pressure across the associated expansion device, and the % symbol is the percentage of opening of the associated expansion valve, with $C_v$ being a characteristic constant of the associated expansion device.

12. The control as set forth in claim 7, wherein at least one of said two methods utilizes the following formula:

$$m_r = \frac{m_a c_{p1}(T_{1in} - T_{1out})}{SHR(h_{r1} - h_{r2})},$$

wherein $m_a$=mass flow rate of air kg/s $m_r$=mass flow rate of refrigerant kg/s across an associated evaporator $c_{p1}$=specific heats of dry air, J/kgK $T_1$in/out=air temperature (into and out of an associated evaporator), ° C.

SHR=sensible heat ratio determined from the air conditions into and out of the associated evaporator $h_{r1}$, $h_{r2}$=specific enthalpies of refrigerant vapor at inlet and outlet of the associated evaporator, J/Kg.

13. A method of determining a low charge of refrigerant comprising:

providing a compressor for compressing refrigerant and delivering refrigerant downstream to a condenser, refrigerant passing from said condenser to an expansion device, and from said expansion device to an evaporator, refrigerant from said evaporator passing back to said compressor;

controlling said refrigerant system, and providing system variables from a plurality of sensors to a control, and said control calculating mass flow rates by at least two methods based upon said system variables, and said control comparing said mass flow rate calculations by said two methods to each other, and indicating a low charge of refrigerant in said refrigerant system should said two mass flow rate calculations differ by more than a predetermined amount; and at least one of said two methods is calculated based upon a compressor model, and looking at a pressure ratio across said compressor.

14. The method as set forth in claim 13, wherein the other of said two methods is calculated by taking the differential pressure across said expansion device and utilizing a formula to calculate mass flow rate.

15. The method as set forth in claim 13, wherein the other of said two methods is calculated by looking at a formula based upon a heat transfer rate across said evaporator.

16. The method as set forth in claim 13, wherein at least one of said two methods is calculated by taking the differential pressure across said expansion device and utilizing a formula to calculate mass flow rate.

17. The method as set forth in claim 13, wherein at least one of said two methods is calculated by looking at a formula based upon a heat transfer rate across said evaporator.

* * * * *